US005291908A

United States Patent [19]

Grady, II

[11] Patent Number: 5,291,908

[45] Date of Patent: Mar. 8, 1994

[54] POWERED UMBRELLA

[76] Inventor: Clyde C. Grady, II, P.O. Box 303, Baytown, Tex. 77522

[21] Appl. No.: 929,888

[22] Filed: Aug. 10, 1992

Related U.S. Application Data

[63] Continuation-in-part of Ser. No. 612,526, Nov. 13, 1990, Pat. No. 5,213,122.

[51] Int. Cl.[5] ..... A45B 25/14

[52] U.S. Cl. ..... 135/22; 135/20.3

[58] Field of Search ..... 135/22, 203

[56] References Cited

U.S. PATENT DOCUMENTS

| | | | |
|---|---|---|---|
| 4,424,824 | 1/1984 | Becher | 135/20.3 |
| 4,572,226 | 2/1986 | Williams | 135/22 |
| 4,766,920 | 8/1988 | Grady | 135/22 |

FOREIGN PATENT DOCUMENTS

| | | | |
|---|---|---|---|
| 19334 | of 1890 | United Kingdom | 135/22 |

*Primary Examiner*—Henry E. Raduazo

[57] ABSTRACT

This invention relates to umbrellas in general. In particular it relates to umbrellas which automatically open and close. This automatic opening and closing of the umbrella in the presented embodiments is accomplished by means of the rotation of a threaded rod.

The improvements disclosed herein relate to improved means for more economically controlling the source of motive power used to open and close the umbrella.

A key improvement disclosed herein includes a means for conserving the power of the batteries used to power the motor which causes the threaded rod to open and close the umbrella embodiments utilizing this means of opening and closing.

An additional improvement disclosed is the use of a multiple-lead threaded rod which avoids the binding and "cross-threading" of previous designs.

Also disclosed is a means for conveniently converting the umbrella to the ordinary manually opened and closed umbrella should the necessity occur.

Two different mechanisms are also disclosed whereby such electrically powered umbrellas can be collapsed to a shorter length. In one such mechanism the length is alternately lengthened and shortened manually. In another mechanical arrangement invented, the electric motor which opens and closes the umbrella ribs also simultaneously lengthens and shortens the umbrella shaft.

4 Claims, 5 Drawing Sheets

FIG. 1
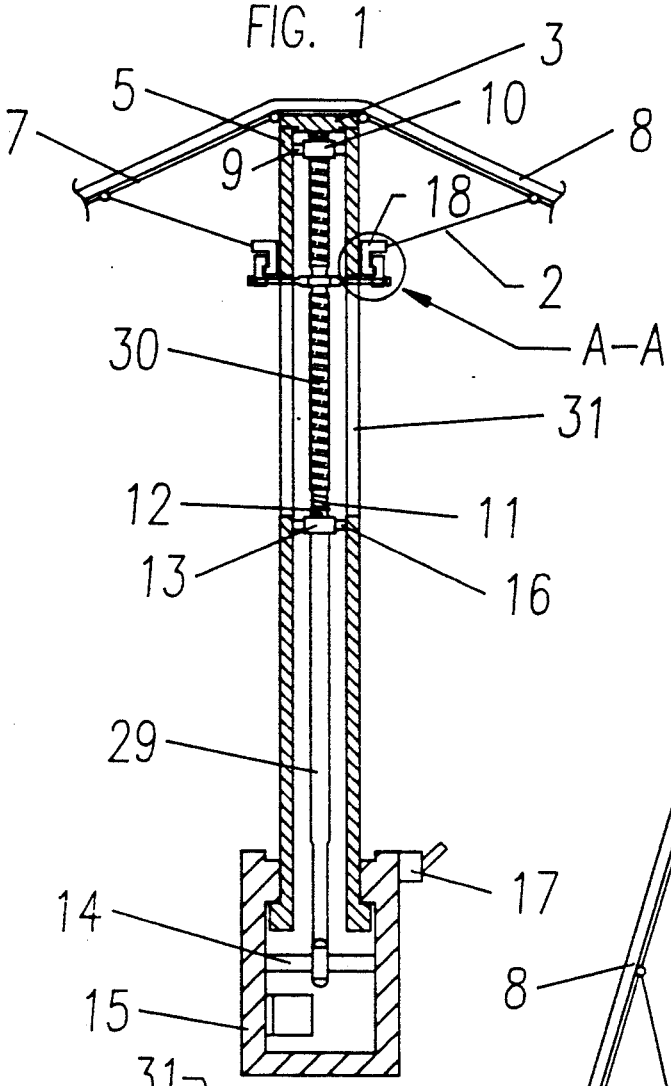
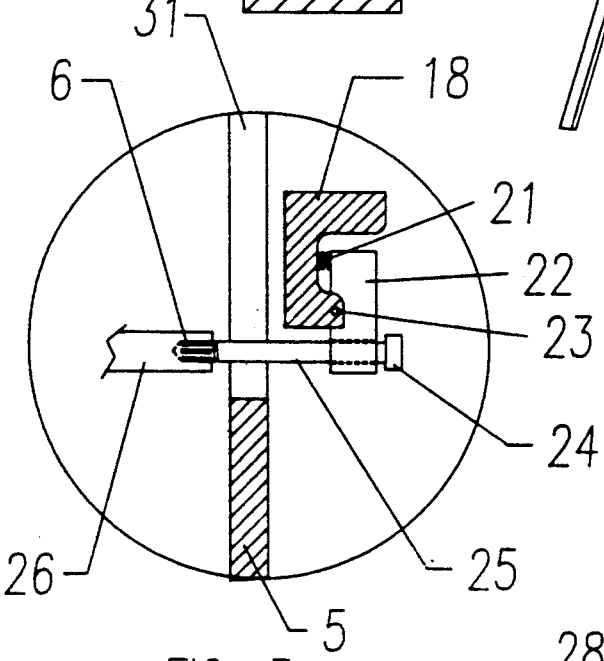
FIG. 3
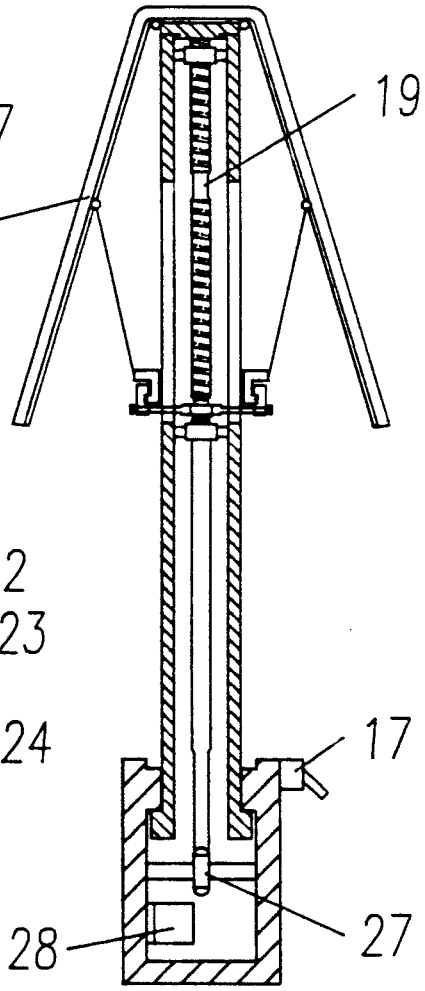
FIG. 2

FIG. 5
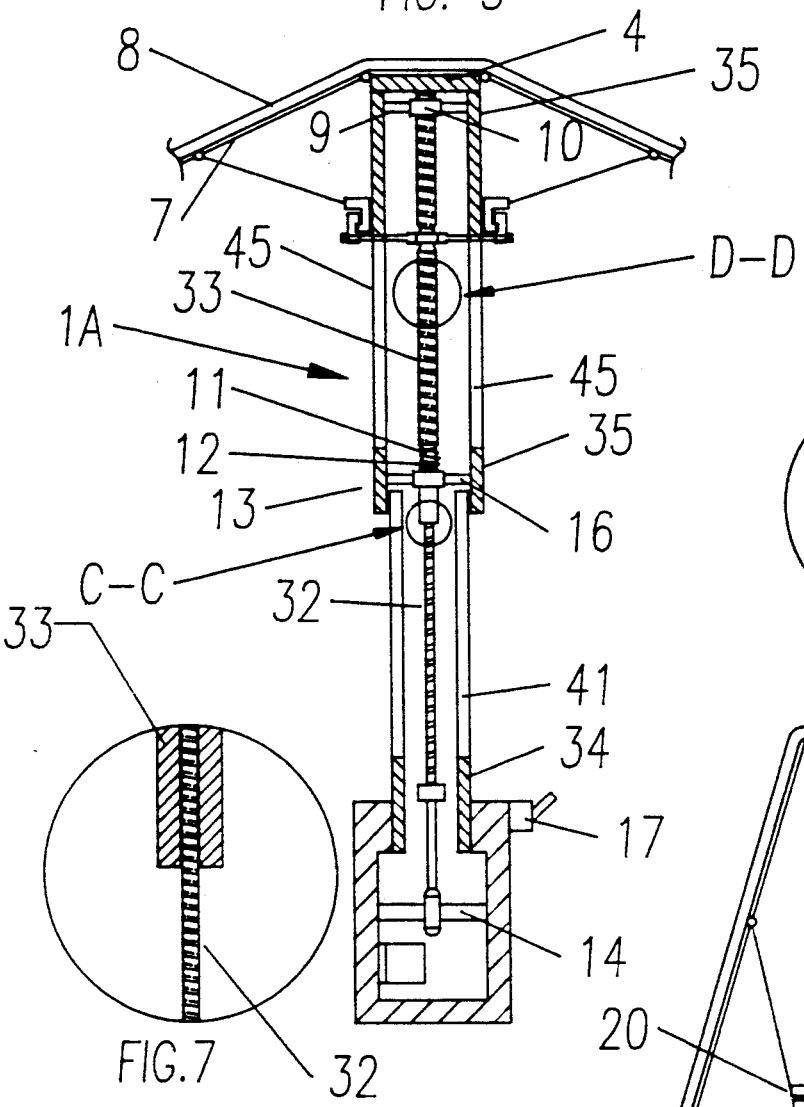
FIG.7
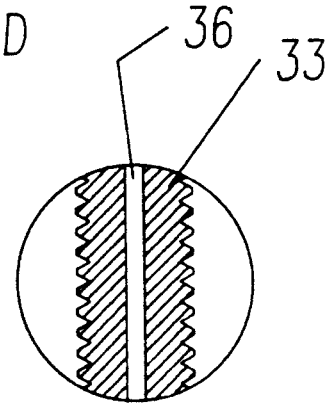
FIG. 6
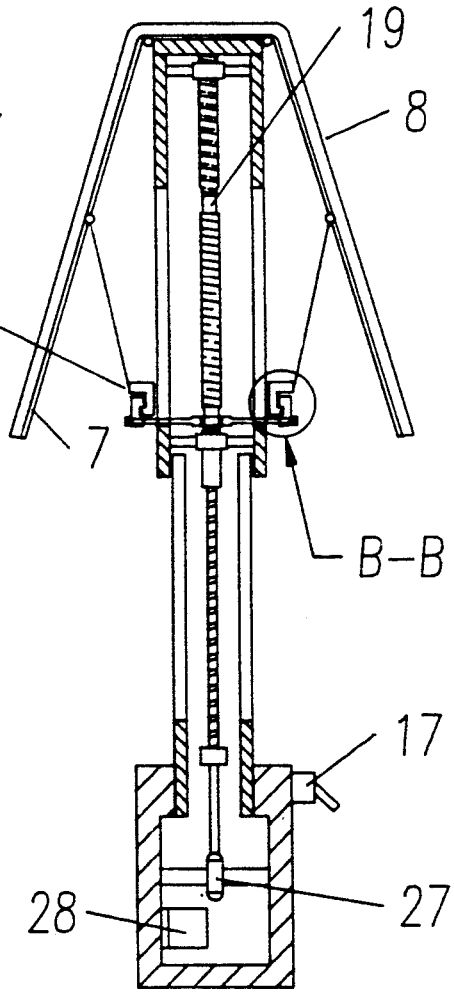
FIG. 8
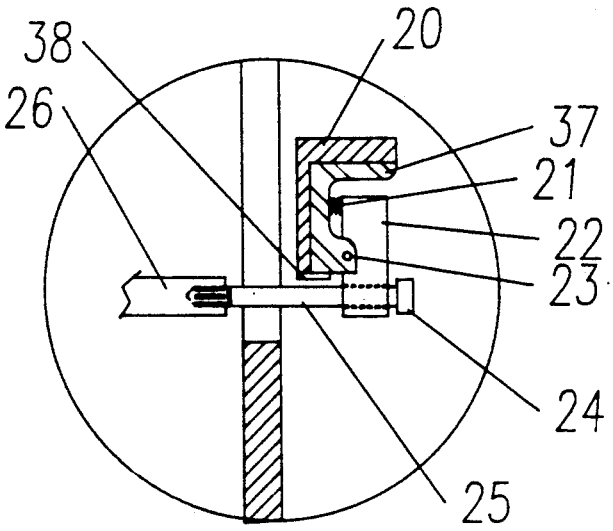
FIG. 4

FIG. 9
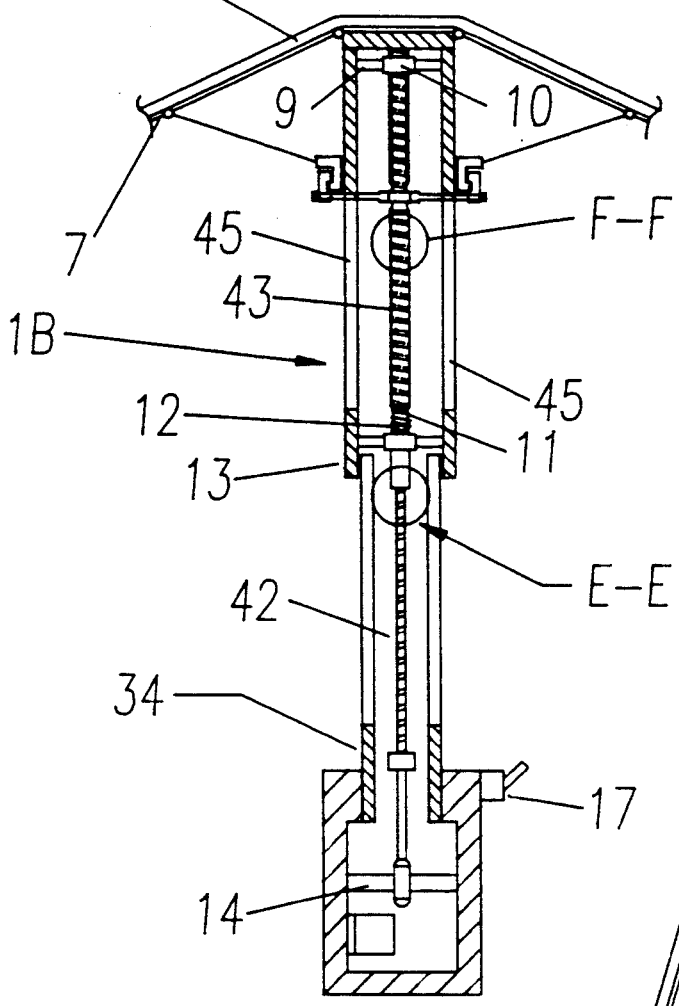
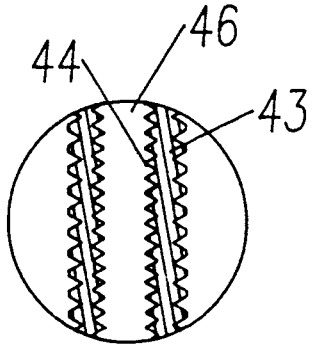
FIG. 10
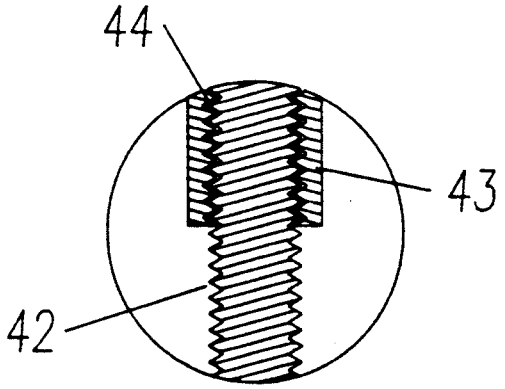
FIG. 11
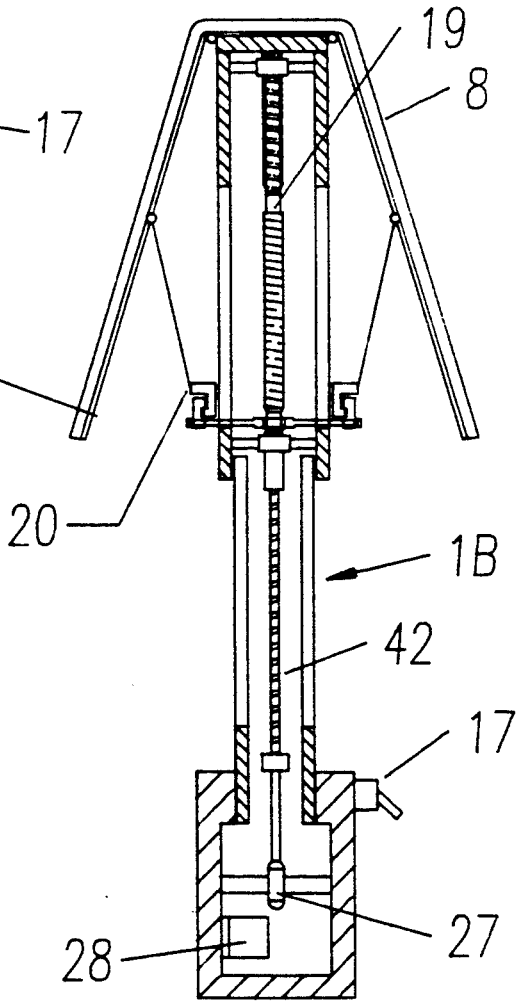
FIG. 12

FIG. 13
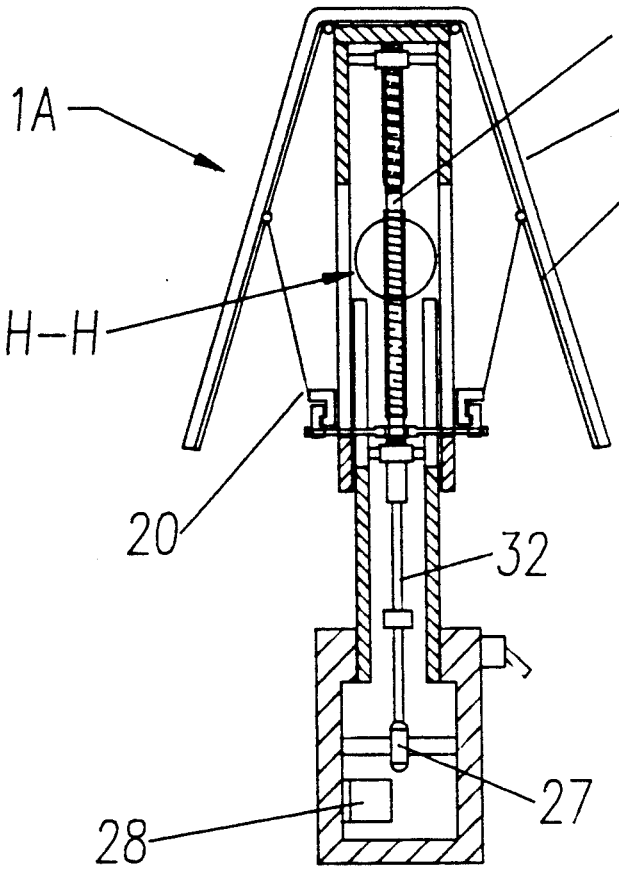
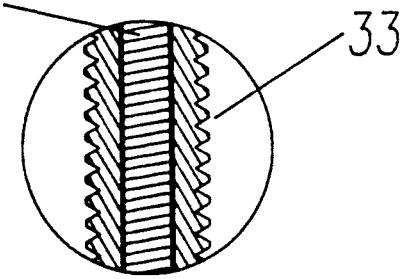
FIG. 14
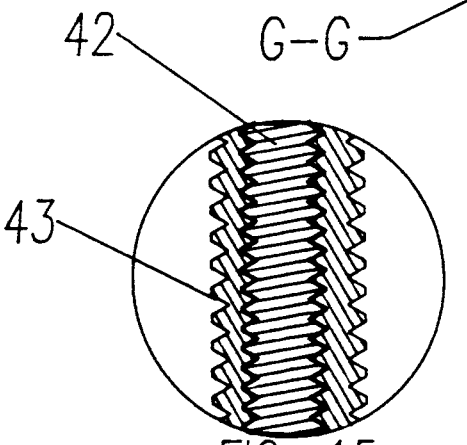
FIG. 15
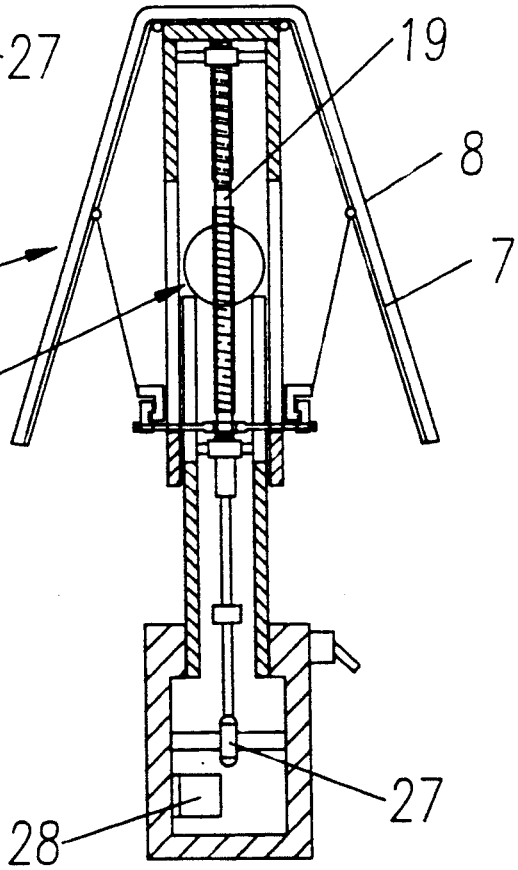
FIG. 16

FIG. 17
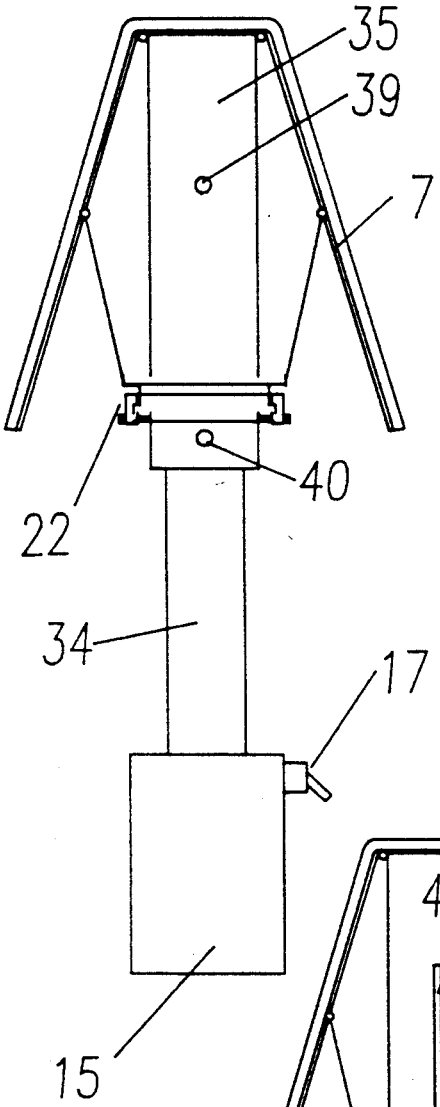
FIG. 18
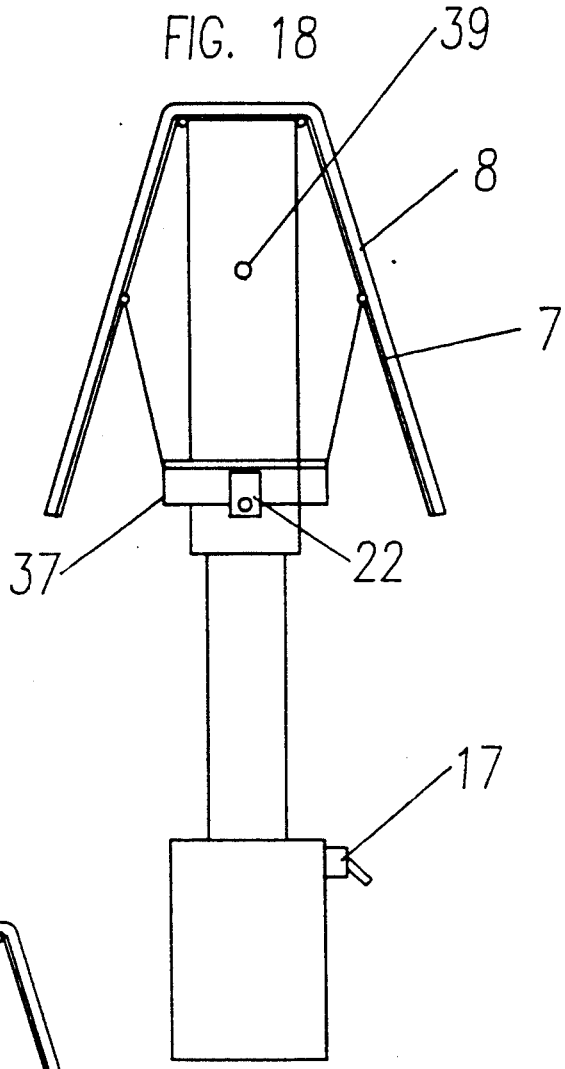
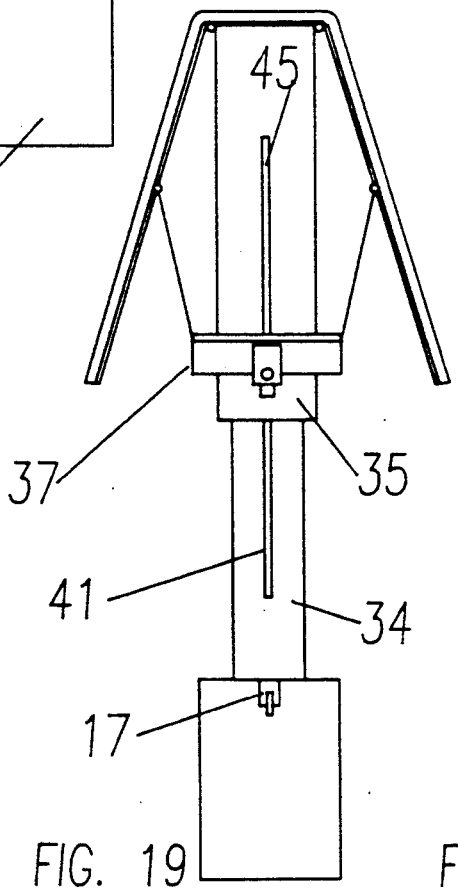
FIG. 19
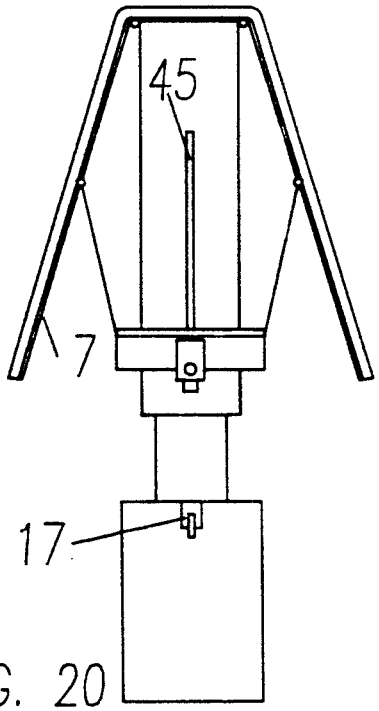
FIG. 20

POWERED UMBRELLA

CROSS-REFERENCE TO RELATED APPLICATIONS

This application is a continuation in part of Ser. No. 07/612,536 filed Nov. 13, 1990 and now U.S. Pat. No. 5,213,122.

BACKGROUND ART

It is known in the art to construct umbrellas which open automatically with the manual release of a catch wherein the compression of a spring causes a hollow member, to which the ribs of the umbrella are attached, to move along a shaft extending through the hollow member. It is also known in the art to provide means for the biasing closed of the umbrella by springs. However, the umbrellas of the art in general require the movement of the hand from one position to another in order to effect closing or even worse require the use of two hands. Alternatively, or conincidentally, the user of such umbrellas which use springs to automatically open and close must remember to compress the spring each time before using the umbrella. Without this prior spring compression such existing umbrellas cannot even be opened, let alone closed. Further, umbrellas previously disclosed in the art had the disadvantage of the batteries too quickly discharging to attain a satisfactory number of openings and closings from one battery charge. In addition, the previously disclosed umbrella embodiments had the disadvantage of not being collapsible to a shorter shaft length for ease of storage and carrying.

DESCRIPTION OF DRAWINGS

FIG. 1 contains a sectional view of the umbrella mechanism of fixed shaft length, which is provided with specific means for conserving battery power, wherein the umbrella ribs are shown in the open or extended position.

FIG. 2 contains a sectional view of the umbrella mechanism of FIG. 1 wherein the ribs 7 of embodiment 1 are in a closed position.

FIG. 3 presents in sectional view Detail A-A of FIG. 2.

FIG. 4 contains a Detail B-B of FIG. 8.

FIG. 5 contains a sectional view of an umbrella mechanism wherein manually operated means is disclosed for alternately lengthening and shortening the umbrella shaft, wherein the umbrella ribs are in an opened position.

FIG. 6 contains a Detail D-D of FIG. 5.

FIG. 7 contains a Detail C-C of FIG. 5.

FIG. 8 contains a sectional view of the umbrella embodiment 1A of FIG. 5 wherein the ribs, 7, of embodiment 1A are in a closed position.

FIG. 9 contains a sectional view of an umbrella embodiment 1B wherein the motor contained in motor housing 27, which opens and closes the umbrella ribs 7 is also used to automatically lengthen and shorten the umbrella shaft, wherein the ribs, 7, of embodiment 1B are shown in an opened position.

FIG. 10 contains Detail F-F of FIG. 9.

FIG. 11 contains Detail E-E of FIG. 9.

FIG. 12 contains a sectional view of the embodiment 1B of FIG. 9 wherein the ribs 7 of embodiment 1B are an opened position.

FIG. 13 shows in sectional view the embodiment 1A of FIGS. 4 through 8 with the lower tube shaft 34 inserted up into upper tube shaft 35 a greater distance than that shown in FIGS. 5 & 8 to attain a shortened overall length of the embodiment 1A.

FIG. 14 contains Detail H-H of FIG. 13.

FIG. 15 contains Detail G-G of FIG. 16.

FIG. 16 illustrates in sectional view the umbrella mechanism of FIGS. 9 thru 12 with the lower tube shaft 34 inserted up into upper tube shaft 35 a greater distance than that shown in FIGS. 5 & 8 to attain a shortened overall length of the embodiment 1A.

FIG. 17 shows the umbrella embodiments 1A and 1B of FIGS. 5 and 9 as they appear in side planar view.

FIG. 18 depicts the utilization of donut collar 37 and improved collar 20, which can be used to facilitate the conversion of the umbrella embodiments 1, 1A, and 1B described herein from the powered to the manually operated opening and closing of the umbrella ribs 7.

FIG. 19 shows the umbrella embodiments 1A and 1B of FIGS. 8 and 12, respectively, as they appear in side planar view after rotation of the entire umbrellas through an angle of 90 degrees about the longitudinal axis of the upper tube shaft relative to the respective positions of embodiments 1A and 1B in FIGS. 8 and 12.

FIG. 20 shows the umbrella embodiments 1A and 1B of FIGS. 13 and 16, respectively, as they would appear in side planar view after rotation of the entire umbrella embodiments through an angle of 90 degrees about the longitudinal axis of the upper tube shaft 35, relative to the respective positions of embodiments 1A and 1B in FIGS. 13 and 16.

Be it known that, for clarity of presentation, in Figures herein in which the cloth 8 and the ribs 7 are depicted, that the multiplicity of ribs 7 is represented by only two such ribs 7, and the cloth 8, is represented in sectional view only by two parallel lines.

In FIG. 1 can be seen umbrella ribs 7, held in an open position by umbrella struts 2, wherein umbrella ribs 7, are pivotally attached to end piece 3, wherein end piece 3, is affixed to one piece shaft 5, in such a manner that end piece freely rotates within one piece shaft 5, and yet is not readily separated from one piece shaft 5, this attachment being accomplished by various means known to those skilled in the art of mechanical devices.

Strut 2, is pivotally attached to rib 7, at one end and strut 2, is pivotally attached at its opposite end to collar 18. Ribs 7 are covered by and attached to water repellent fabric 8.

FIG. 1 depicts umbrella 1, in which the opening and closing of the umbrella 1, is accomplished by the upward and downward movement of a threaded nut 26 which has been attached to collar 18 by means of thumb shaft 25 extending through shaft slot 31, in one piece shaft 5, such that when threaded rod 30, is threadably inserted and rotated the threaded nut 26, and consequently the collar 18, move upward and downward.

The location and extent of shaft slot 31, is shown in FIG. 1 and in the sectional views of the Figures that follow by the absence of crosshatching in the cross-sectional view of one piece shaft 5, and upper tube shaft 35—as are lower tube shaft slot 41 and upper tube shaft slot 45.

As shown in FIG. 1, the rotating shaft of the bidirectional motor contained in motor housing 27, is attached to the lower end of drive shaft 29. Drive shaft 29, is, in turn, attached to threaded rod 30. The motor housing 27, is attached by means of motor support 14, to the handle 15. By means of electric circuitry commonly known in the art of electronics the potential energy stored in battery 28, can be used to make, with the movement of position switch 17, to one of its available positions, the shaft of the electric motor 27, to rotate in a given direction causing the upward or downward motion of threaded nut 26. Movement of the position switch 17, to yet another position can be made to effect the rotation in the opposite direction of the shaft of electric motor 27. This, of course, causes movement of threaded nut 26, and consequently of collar 18, in a direction opposite to that previously induced. In this manner the umbrella can be made to open and close automatically, where the open position of the umbrella is shown in FIG. 1 and the closed position is shown in FIG. 2.

FIG. 1 further shows the threaded rod 30, to have an area of upper area of reduced diameter, 19, which has been formed on the rod 30, on its uppermost end, wherein this area of reduced diameter is devoid of threads so that even though rod 30 is rotated the threaded nut 26, will not be urged further upward beyond the area 19. The function of this uppermost area of reduced diameter is to allow "unloading" of the motor in motor housing 27, when the threaded nut 26, reaches it's uppermost position upon opening of the umbrella. It has been found that this improvement does not prematurely discharge the battery 28, and allows the use of a lower torque rating on the motor 27, and at the same time extends the life of the motor 27. However, this improvement still allows the threaded nut 26, to progress downward on the threaded rod 30, to the lowermost end of threaded rod 30 and to thereby close the umbrella when the direction of rotation of the motor in motor housing 27, is reversed by reversing the direction of rotation of the threaded rod 30 from the direction of rotation of the rod 30 used to open the umbrella.

There may be additionally provided at the lowermost end of the rod 30 a lowermost area of reduced diameter 11 of the rod 30, wherein this lowermost area of reduced diameter 11, is likewise not provided with threads but smooth in circumference. This lowermost area of reduced diameter 11, serves a function similar to those provided by the uppermost area of reduced diameter 19 with similar benefits.

The spring 12, shown in FIGS. 1 and 2 as attached at its lowermost end to a stationary positioner 13, which is in turn fixed in its relative axial position on the rod 30 has been shown to aid in the restarting of the threaded nut 26 on the threaded portion of rod 30 when the threaded nut 26 is starting from the lowermost area of reduced diameter 11. Spring 12 can also be directly attached to the threaded rod 30 or simply allowed to attain the position shown in FIGS. 1 and 2 by mere gravity. The spring 12 is situated so that it is compressed upon movement of the threaded nut 26 onto the lowermost area of reduced diameter 11 and is of sufficient force to keep threaded nut 26 urged upward toward the threaded portion of rod 30 and hence allows smooth restarting of the threaded nut 26 on the threaded rod 30 when the motor 27 is actuated in the direction required to open the umbrella.

The spring 12, as well as the areas of reduced diameter 19 and 11 are likewise shown in the improved embodiments 1A and 1B shown in FIGS. 5, 8, 9, 12, 13, 16, 17, 18, 19, and 20. Further, in FIGS. 1 and 2, the threaded rod 30, is shown attached to the one piece shaft 5, by upper bearing 10 and stationary positioner 13 which respectively are fixed in upper support strut 9 and lower support strut 16, affixed to one piece one piece shaft 5, wherein stationary positioner 13 also acts as a lower most bearing.

The threaded rod 30 turns freely by virtue of the upper most bearing 10 and lower stationary positioner 13. Drive shaft 29, transfers motive power from motor contained in motor housing 27 to threaded rod 30, while reinforced motor support 14 insures adequate support of motor housing 27 and attaches it to handle 15.

FIG. 3 shows in detail how an apparatus consisting of thumb shaft 25, thumbpiece 24, arm 22, pin 23 and thumb spring 21 can be used to attach collar 18 to threaded nut 26. Since thumb shaft 25, threadably inserts into cavity 6 threaded nut 26, ;or is held in an unthreaded version of cavity 6 by spring 21, when the battery 28 expires, thumb shaft 25 can be detached from the threaded nut 26, and the collar 18 actuated manually to open and close the umbrella. Shaft 25 once so detached from threaded nut 26, can be inserted in properly placed holes (not shown) in one piece shaft 5, to manually secure the umbrella in either the open or the closed position. Thus, the umbrella can still be used in the manual mode even if the battery power is expended while it is raining.

Finally, it has been found more or less advantageous to the smooth operation of the umbrella embodiments 1, 1A & 1B that the threaded rod, 30, be fabricated such that there at least two separate parallel threads which run along its length. The threaded nut, 26, must likewise be fitted with matching parallel threads, of course. These parallel threads are sometimes referred to as multiple leads. The use of multiple leads serves to, by some mechanism, keep the threaded nut, 26, from binding and becoming "cross-threaded" when trying to restart its travel on the threaded rod, 30, from the areas of reduced diameter, 19 and 11, at the uppermost and lowermost ends, respectively, of the threaded rod, 30.

It is expressly within the scope of the invention shown in FIGS. 1 and 2 as well as the other embodiments 1A and 1B of the invention disclosed that motor housing 27 may contain not only the electric motor itself, but also gearing which increases or decreases the revolutions per minute available from the motor itself in application to driveshaft 29, flattened drive shaft 32, or threaded drive shaft 42, as appropriate. Said motor housing may also contain any of various torque limiting devices as known in the art.

FIG. 4 illustrates in Detail B-B, an improved collar 20, onto which donut collar 37 has been fitted. Donut collar 37 is held in place on improved collar 20, by retainer 38 which is fixed to improved collar 20, but retainer 38 allows donut collar 37 to freely rotate in a radial direction relative to improved collar 20, to which are attached the ribs 7. By virtue of improved collar 20, and donut collar 37 and retainer 38, greater freedom is potentially attained in placement of the previously indicated holes in the one-piece shaft 5 of FIG. 1, or the upper tube shaft 35 of FIG. 5, into which thumb shaft 25 can be placed to manually secure the ribs 7 in the open position shown in FIGS. 1 and 5 or the closed position shown in FIGS. 2 and 8 upon disengagement of thumbshaft 25 from threaded nut 26. For purposes of illustration, these aforementioned holes in the upper tube shaft 35 are shown in planar view in FIG. 17 as being radially situated 90 degrees from shaft slot 31 and labeled therein as upper shaft hole 39 and lower shaft hole 40.

FIG. 5 illustrates an embodiment of the invention in which one piece shaft 5, of FIGS. 1 and 2 has been replaced in FIG. 5 by lower tube shaft 34 which is, in turn, attached to handle 15 and fits within upper tube shaft 35, which is attached to alternate end piece 4, which is, in turn, pivotally attached to ribs 7.

In FIG. 5 the position of lower tube shaft slots 41 are shown with respective to position and extent by the absence of crosshatching in lower tube shaft 34.

Also in FIG. 5, the threaded rod 30 of FIG. 1 has been replaced by hollow threaded rod 33. FIG. 5 also discloses that the drive shaft 29 of FIG. 1 has been replaced in FIG. 5 by flattened drive shaft 32.

And finally in FIG. 5, alternate end piece 4, is shown to have replaced end piece 3 shown in FIG. 1, wherein alternate end piece 4 is affixed to upper tube shaft 35 such that it does not rotate freely within upper tube shaft 35—thereby accomplishing greater strength and ease of construction in some instances. Be it known that end piece 3 could also be used in conjunction with embodiments 1A and 1B if desired.

FIG. 6, as Detail D-D, illustrates this hollow interior cavity 36 within hollow threaded rod 33.

FIG. 7 as Detail C-C shows that flattened drive shaft 32, extends up into hollow threaded rod 33 at the lower extremity of threaded rod 33 even when the lower tube shaft 34 only slightly extends into upper tube shaft 35 as shown in FIG. 7. This is true even though the interior of hollow threaded rod 33 is empty at its uppermost end as shown in FIG. 6 when the lower tube shaft 34 and the upper tube shaft 35 are in the extended position as shown in FIGS. 5 and 8. Note that due to the flattened shape of flattened drive shaft 32 and the corresponding contour of the cavity 36, in threaded rod 33, that threaded rod 33 is made to turn by turning flattened drive shaft 32 but that flattened drive shaft 32 still moves freely in the vertical direction within the hollow internal cavity 36 of threaded rod 33.

FIG. 8 merely illustrates that when threaded nut 26, attains the lowermost area of reduced diameter 11, the ribs 7, have attained the collapsed position shown.

FIG. 9 contains an illustration of embodiment 1B of the invention disclosed wherein the flattened drive shaft 32, and the hollow threaded rod 33 of embodiment 1A in FIG. 5 have been replace respectively, by threaded drive shaft 42 and internally/externally threaded rod 43. Like threaded rod 29 and hollow threaded rod 33, the external threads of internally/externally threaded rod 43 are preferentially of multiple lead. Internally/externally threaded rod 43, is also fitted with the uppermost area of reduced diameter 19 and the lowermost area of reduced diameter 11 as shown in FIG. 9.

FIG. 10, however, illustrating Detail F-F of FIG. 9, shows that the interior of internally/externally threaded rod 43 is not only hollow but contains a female-threaded surface 44.

FIG. 11 shows as Detail E-E that threaded drive shaft 42, threadably extends up into internall/externally threaded rod 43 at the lower extremity of internall/externally threaded rod 43 even when the lower tube shaft 34 only slightly extends into upper tube shaft 35 as shown in FIG. 9. This is true even though the interior 46, of internall/externally threaded rod 43 is empty at its uppermost end as shown in FIG. 10 when the lower tube shaft 34 and the upper tube shaft 35 are in the extended position as shown in FIGS. 9 and 12.

FIG. 12 merely illustrates that when threaded nut 26, attains the lowermost area of reduced diameter 11, the ribs 7 of embodiment 1B have attained the collapsed position shown.

FIG. 13 shows embodiment 1A after lower tube shaft 34 has been manually pushed a distance up into the upper tube shaft 35 while simultaneously flattened drive shaft 32, has pushed up into the hollow interior cavity 36 of hollow threaded rod 33 as illustrated in Detail H-H of FIG. 14.

FIG. 15 illustrates Detail G-G of embodiment 1B contained in FIG. 16 shows that, correspondingly, when threaded drive shaft 42 is threadably inserted into the uppermost interior of internally/externally threaded rod 43 by the action of the motor in motor housing 27 turning threaded drive shaft 42, the lower tube shaft 34 is thereby pulled up into upper tube shaft 35, thereby shortening the overall length of the embodiment 1B which, in turn, contributes to greater ease in storage.

FIG. 17 as previously stated depicts in planar view the embodiments 1A and 1B, which are depicted in FIGS. 8 and 12, respectively, in sectional view, in the same relative configuration of component parts with upper shaft tube 35 and lower shaft tube 34 in the fully extended shaft configuration, as well as the ribs 7 in the collapsed position, with thumb shaft 25 inserted into threaded nut 26. Also apparent in FIG. 17 are upper shaft hole 39 and lower shaft hole 40.

FIG. 18 reflects the embodiments of FIG. 17 after donut collar 37 has been rotated through an angle of 90 degrees following disengagement of thumbshaft 25 from threaded nut 26 (not shown in FIG. 18), followed by insertion of thumbshaft 25 into lower shaft hole 40, wherein these steps constitute the conversion of the embodiments 1A and 1B from the automatic, powered opening and closing of the ribs 7 to the manual mode of opening and closing the ribs, 7.

FIG. 19 reflects the embodiments 1A and 1B as depicted in FIG. 17 after rotating the aforesaid embodiments 90 degrees counterclockwise about the longer axis of the lower tube shaft 34, thereby revealing to better inspection the upper tube shaft slot 45 and lower tube shaft slot 41.

FIG. 20 depicts the embodiments 1A and 1B as represented in FIG. 19 after lower tube shaft 34 has been inserted up into upper tube shaft 35, wherein this insertion is accomplished manually in the case of embodiment 1A. In the case of embodiment 1B this aforesaid insertion is accomplished by the action of the motor in motor housing 27, turning threaded drive shaft 42 up into internally/externally threaded rod 43.

While I have thus described the preferred embodiment of the present invention, many variations will be apparent to those skilled in the art and it must be understood that the foregoing description is intended to be illustrative only and not limitative of the present invention. All such variations and modifications as are in accord with the principles described are meant to fall within the scope of the appended claims.

What is claimed is:

1. An umbrella having a frame of interconnected ribs covered by cloth and a means for the automatic opening and closing of the aforesaid ribs and cloth comprising:

a hollow one piece shaft provided with at least one slot extending therethru along a portion of its length;

a collar which slides along the exterior surface of the aforesaid hollow one piece shaft, wherein said collar is connected to the aforesaid interconnected ribs;

a threaded nut located concentrically within the aforesaid one piece shaft, a reversible motor capable of driving said threaded rod in two directions to extend or close said umbrella; and at least one pin extending through said at least one slot, said at least one pin being detachable from said threaded nut without being detached from said collar whereby said collar may be manually slid up and down the length of said hollow shaft to manually open and close said cloth and ribs.

2. The umbrella of claim 1 wherein there is further provided that the aforesaid pin once detached from the aforesaid threaded nut, said pin or other means may be used to manually secure the ribs and cloth in either the open or closed position.

3. An umbrella having a frame of interconnected ribs covered by cloth and a means for the automatic opening and closing of the aforesaid ribs and cloth comprising:

an upper tube shaft connected to said ribs and provided with at least one slot extending therethru along a portion of its length;

a lower tube shaft, inserted at one of its ends concentrically into said upper shaft;

a collar which slides along the exterior surface of the aforesaid upper tube shaft;

a threaded nut located concentrically within the aforesaid upper tube shaft and the said threaded nut is attached to the aforesaid collar by means of at least one pin extending through at least one slot provided in the aforesaid upper tube shaft, wherein said pin is detachable from said threaded nut without detachment from said collar;

a hollow threaded rod threadably inserted at one of its ends into the aforesaid threaded nut;

a reversible motor fixed relative to said lower tube having a drive shaft adjustably insertable into said hollow threaded rod such that when said motor is operated said hollow threaded rod is made to turn; and wherein, the overall length of the said umbrella may be shortened or lengthened, respectively by means simultaneously altering the distance that said lower tube shaft is inserted into said upper tube shaft and the distance that said drive shaft is inserted into said hollow threaded rod.

4. The umbrella of claim 3 wherein:

the aforesaid hollow threaded rod contains a female thread along its interior surface and the aforesaid drive shaft contains a matching male thread on its outer surface such that when said reversible motor turns in a first direction, said umbrella is shortened by increasing the amount of insertion of the drive shaft into the threaded rod, and when said reversible motor turns in a second direction, said umbrella is lengthened by decreasing the amount that said drive shaft is inserted into the threaded rod.

* * * * *